US012349742B2

(12) United States Patent
Lee

(10) Patent No.: US 12,349,742 B2
(45) Date of Patent: Jul. 8, 2025

(54) SPLIT GRIP SOCK DEVICE

(71) Applicant: Joshua Lee, Silverdale, WA (US)

(72) Inventor: Joshua Lee, Silverdale, WA (US)

( * ) Notice: Subject to any disclaimer, the term of this patent is extended or adjusted under 35 U.S.C. 154(b) by 0 days.

(21) Appl. No.: 18/528,898

(22) Filed: Dec. 5, 2023

(65) Prior Publication Data

US 2024/0358092 A1 Oct. 31, 2024

Related U.S. Application Data

(60) Provisional application No. 63/461,938, filed on Apr. 26, 2023.

(51) Int. Cl.
*A41B 11/00* (2006.01)

(52) U.S. Cl.
CPC ..... *A41B 11/008* (2013.01); *A41B 11/003* (2013.01); *A41B 11/004* (2013.01)

(58) Field of Classification Search
CPC ... A41B 11/004; A41B 11/007; A41B 11/008; A43B 5/12; D04B 9/46
See application file for complete search history.

(56) References Cited

U.S. PATENT DOCUMENTS 4,651,354 A * 3/1987 Petrey ..... A44B 6/00 36/9 R
4,856,505 A * 8/1989 Shaffer ..... A61F 13/068 602/30
5,092,347 A * 3/1992 Shaffer ..... A61F 13/064 128/892
5,617,585 A 4/1997 Fons
5,737,776 A * 4/1998 Jennings ..... A41B 11/14 2/409
7,346,935 B1 * 3/2008 Patterson ..... A41B 11/008 2/239
8,220,077 B1 * 7/2012 Ott ..... A41B 11/008 2/409
D773,796 S * 12/2016 Hobgood ..... D2/959
D794,317 S * 8/2017 Stewart ..... D2/954
D804,162 S * 12/2017 Patterson ..... D2/980
11,285,032 B2 3/2022 Eugene
2005/0091725 A1 * 5/2005 Alley ..... A41D 19/01558 2/139
2005/0144703 A1 * 7/2005 Hilbert ..... A41B 11/008 2/239
2011/0302699 A1 * 12/2011 Kaneda ..... D04B 1/26 2/239

(Continued)

FOREIGN PATENT DOCUMENTS

WO WO-2022137051 A1 * 6/2022 ..... A41B 11/008

*Primary Examiner* — Jillian K Pierorazio
(74) *Attorney, Agent, or Firm* — Brennan, Manna & Diamond, LLC

(57) ABSTRACT

A split grip sock device is disclosed that reduces slippage during lateral movements commonly performed during sports like basketball, tennis, soccer, and football. The device solves these problems by adding grip to the bottom of the sock and having a separate compartment for the big toe which allows for improved pivoting and change of direction. Further, the device also provides cushioning over the metatarsals to alleviate shoelace pressure and over the heel area to prevent blisters. Specifically, the split grip sock device comprises a thicker weave over the top of the foot and heel, with heat-pressed rubber pieces on the bottom of the sole.

10 Claims, 3 Drawing Sheets

(56) References Cited

U.S. PATENT DOCUMENTS

| | | | | |
|---|---|---|---|---|
| 2012/0090077 | A1* | 4/2012 | Brown | A41B 11/007 2/239 |
| 2013/0152275 | A1* | 6/2013 | Crosby | A41B 11/008 2/239 |
| 2013/0263360 | A1* | 10/2013 | Thibodeau | A43B 11/00 36/91 |
| 2013/0283637 | A1* | 10/2013 | Wilkenfeld | A43B 7/26 36/8.3 |
| 2014/0033567 | A1* | 2/2014 | Heathcote | A43B 5/12 36/92 |
| 2014/0128785 | A1* | 5/2014 | Dickson | A61H 1/008 601/84 |
| 2014/0223630 | A1* | 8/2014 | Johnson | A41D 13/0015 2/69 |
| 2015/0216262 | A1* | 8/2015 | Shin | A41B 11/005 2/239 |
| 2017/0055590 | A1* | 3/2017 | Mirbagheri | A41B 11/007 |
| 2017/0164681 | A1* | 6/2017 | Frank | A43B 23/025 |
| 2018/0317565 | A1* | 11/2018 | McCuaig | A41B 11/007 |
| 2019/0082746 | A1 | 3/2019 | Storelli | |
| 2019/0159548 | A1 | 5/2019 | Strelli | |
| 2019/0167462 | A1* | 6/2019 | Shaffer | A61F 5/0127 |
| 2019/0289956 | A1* | 9/2019 | Eugene | A43B 7/1475 |
| 2020/0100927 | A1* | 4/2020 | Eugene | A61F 5/019 |
| 2020/0164610 | A1* | 5/2020 | Davis | B32B 27/32 |
| 2020/0329782 | A1* | 10/2020 | Kim | A41B 11/007 |
| 2021/0120886 | A1* | 4/2021 | Webb | A41D 13/0015 |
| 2021/0337884 | A1* | 11/2021 | Kim | A41B 11/008 |
| 2022/0125128 | A1* | 4/2022 | Blecha | A41B 11/008 |

* cited by examiner

SPLIT GRIP SOCK DEVICE

CROSS-REFERENCE TO RELATED APPLICATION

The present application claims priority to, and the benefit of, U.S. Provisional Application No. 63/461,938, which was filed on Apr. 26, 2023, and is incorporated herein by reference in its entirety.

FIELD OF THE INVENTION

The present invention relates generally to the field of split grip sock devices. More specifically, the present invention relates to performance socks for those who play sports requiring significant lateral movement like basketball, soccer, football, and tennis. Accordingly, the present disclosure makes specific reference thereto. Nonetheless, it is to be appreciated that aspects of the present invention are also equally applicable to other like applications, devices, and methods of manufacture.

BACKGROUND

By way of background, this invention relates to improvements in split grip sock devices. Generally, playing sports like basketball, soccer, football, and tennis with standard socks can be uncomfortable and inefficient. Fast, aggressive movements can lead to slipping, especially when a high amount of sweat is present within the footwear. Further, shoelace pressure over the top of the foot can be uncomfortable and can lead to blisters and decreased blood circulation. Blisters may also form on the heel area due to modern footwear being created with thin materials to ensure the footwear remains lightweight.

Conventionally, a sock consists of only an elongated fabric pocket. When worn with shoes, these socks can cause foot irritation and discomfort, especially when a user is participating in a sport which requires a lot of movement. For example, the foot can become irritated from deformation of the foot experienced during strenuous activity. In addition, the use of these socks can lead to abnormal reliance on a shoe (as opposed to the foot) for balance support, thus preventing the natural healthy functioning of the foot.

Accordingly, there is a demand for an improved sock that offers support and protection, as well as comfort. More particularly, there is a demand for a split grip sock that reduces slippage during lateral movement commonly performed during sports.

Therefore, there exists a long-felt need in the art for a split grip sock device that provides users with performance socks for those who play sports requiring significant lateral movement like basketball, soccer, football, and tennis. There is also a long-felt need in the art for a split grip sock device that allows users to slide their big toe into a small compartment to enable it to move independently when pivoting and pushing off the ground. Further, there is a long-felt need in the art for a split grip sock device that reduces friction on the top and heel area of the foot via hexagonal cushions or pads on the sock that contact the footwear. Moreover, there is a long-felt need in the art for a device that helps prevent slipping even with high amounts of sweat and moisture present within the shoe. Further, there is a long-felt need in the art for a split grip sock device that improves comfort, performance, and efficiency when playing sports or exercising. Finally, there is a long-felt need in the art for a split grip sock device that reduces slippage and prevents friction during use.

The subject matter disclosed and claimed herein, in one embodiment thereof, comprises a split grip sock device. The device is a sport performance sock that reduces slippage during lateral movement commonly performed during sports like basketball, tennis, soccer, and football. Generally, the device solves these problems by adding grip to the bottom of the sock, having a separate compartment for the big toe which allows for improved pivoting and change of direction, and providing cushioning over the metatarsals to alleviate shoelace pressure and over the heel area to prevent blisters. The split grip sock device comprises a body component that is configured into a separate compartment for the big toe and a second compartment for the rest of the user's toes. The device also features a thicker weave over the top of the foot and heel, with glued and heat-pressed rubber pieces on the bottom of the sole.

Generally, the rubber grip elements have two specific shapes, full red hexagon rubber pieces and blue half hexagon rubber pieces. The full red hexagon rubber pieces are placed underneath the big toe and the part of the ball of the foot directly below the big toe, specifically to provide traction when pivoting and pushing off. The blue half hexagon rubber pieces are positioned in a column on the second and third toes and point vertically up toward the user's toes and allow for traction when running and backpedaling vertically. The blue half hexagon rubber pieces are positioned in a column on the fourth and fifth toes and point toward the lateral side of the user's foot to allow for better traction when moving laterally. Additional blue half hexagon rubber pieces can be positioned around the heel area and big toe area, pointing toward a user's toes to further provide traction when running and backpedaling.

In addition to rubber pieces, the device can compromise two orange hexagon pads on the heels which comprise a thicker/fluffier knit material that provides padding to prevent friction that can cause blisters. Further, the body component can also comprise four orange hexagon pads over the first and second metatarsal and medial and middle cuneiforms which comprise a thicker/fluffier knit material that provides padding to alleviate lace pressure. Furthermore, any number or color of padding and rubber pieces can be utilized to cushion and support the sock device.

In this manner, the split grip sock device of the present invention accomplishes all of the foregoing objectives and provides users with a device that provides traction and support to users while playing sports and other activities. The device is a sock that has a big toe compartment and a compartment for the other toes, as well as traction components on the sole. The device also prevents friction and blisters around the heel area.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a split grip sock device. The device is a sport performance sock that reduces slippage during lateral movement commonly performed during sports like basketball, tennis, soccer, and football. Generally, the device solves these problems by adding gripping pieces to the bottom of the sock, having a separate compartment for the big toe which allows for improved pivoting and change of direction, and providing cushioning over the metatarsals to alleviate shoelace pressure and over the heel area to prevent blisters. The split grip sock device comprises a body component that is configured into a separate first compartment for the big toe and a second compartment for the rest of the user's toes. The device also features a thicker weave over the top of the foot and heel, with glued and heat-pressed rubber pieces on the bottom of the sole.

Accordingly, a split grip sock device for the foot is provided, which can keep a user's toes straight and reduce slippage during lateral movements, resulting in less irritation or discomfort while wearing shoes. Further, the separate toe compartments allow for improved pivoting and change of direction, as needed. The sock device can also reduce friction on the top and heel area of the foot and prevents slipping even with high amounts of sweat and moisture present within the shoe, due to the rubber pieces positioned on the body component.

In one embodiment, the split grip sock device comprises a body component that includes a toe area, an ankle area, an arch area, and a heel area. The split grip sock device is typically to be worn within a normal shoe, such as a professional or athletic shoe. Further, the split grip sock device comprises a body component formed of a tubular knit material with a closed toe portion and closed heel portion, with an open ankle portion for inserting a user's foot during wear. The closed toe portion is separated into a first compartment for accommodating the big toe, and a second compartment for accommodating the four remaining toes.

In one embodiment, the body component also comprises glued and/or heat-pressed rubber pieces on the bottom of the sole for traction and on the heel and top of the body component to reduce friction from the shoe while in use. The rubber pieces can be secured via adhesives, glue, heat-pressing, etc., or any other suitable securing means as is known in the art. Any suitable number of rubber pieces can be applied to any suitable part of the body component, as is known in the art, depending on the needs and/or wants of a user.

Generally, the rubber grip elements have two specific shapes, full red hexagon rubber pieces, and blue half hexagon rubber pieces, although any suitable color and shape can be utilized as is known in the art. Typically, the full red hexagon rubber pieces are placed underneath the big toc and at the part of the ball of the foot directly below the big toe, specifically to provide traction when pivoting and pushing off. Any suitable number and size of hexagon rubber pieces can be utilized on the body component, in any suitable position on the body component, to provide extra cushioning and traction, as needed.

In one embodiment, the blue half hexagon rubber pieces are positioned on the sole of the body component and arranged typically in a column on the second and third toes. Typically, the blue half hexagon rubber pieces point vertically up toward the user's toes and allow for traction when running and backpedaling vertically. The blue half hexagon rubber pieces are also positioned in a column on the fourth and fifth toes. Typically, the blue half hexagon rubber pieces positioned here point toward the lateral side of the user's foot to allow for better traction when moving laterally. Furthermore, additional blue half hexagon rubber pieces can be positioned around the heel area and big toe area, these rubber pieces typically point toward a user's toes to further provide traction when running and backpedaling. Any suitable number and size of hexagon rubber pieces can be utilized on the body component, in any suitable position on the body component, to provide extra traction, as needed.

In one embodiment, in addition to rubber pieces, the device can compromise two orange hexagon pads on the heels which comprise a thicker/fluffier knit material that provides padding to prevent friction that can cause blisters on a user's heel area. Additionally, the body component comprises four orange hexagon pads over the first and second metatarsal and medial and middle cuneiforms which comprise a thicker/fluffier knit material that provides padding to alleviate lace pressure for the user. Furthermore, any number, shape, or color of padding and rubber pieces can be utilized to cushion and support the sock device, as is known in the art.

In one embodiment, the split grip sock device does not comprise any additional padding or cushioning on the heel or top of the foot, but merely provides a plurality of glued and/or heat-pressed rubber pieces on the bottom of the sole for traction.

In one embodiment, the split grip sock device also comprises an area of increased compression extending around the forefoot arch, as well as at the heel and ankle. The area of increased compression can be formed by a tighter or different knitting pattern than the rest of the body component or by incorporating threads of different materials or elasticity into the area. Further, the increased compression of the body component in the arch area will help reduce pain in those individuals with plantar fasciitis and also help those individuals with painful flatfeet by helping to reduce muscle fatigue and strain by pulling up on the plantar fascia and relieving tension on muscles, tendons, and ligaments. The increased compression and pressure in the arch, heel, and ankle will also reduce swelling and edema, and at the same time control the rear foot and ankle, to help reduce ankle strains and sprains and helping heel spurs.

In one embodiment, the split grip sock device is manufactured of a knitted material such as cotton, spandex/lycra, nylon, and/or polyester. The body component can also have an area that utilizes a different material for therapeutic purposes. For example, an area along the outside of the first compartment can be knit with a combination of far-infrared thermos-reactive materials/bio-ceramic threads or copper threads or other threads such as bamboo, as these have therapeutic value. For example, socks incorporating copper can stimulate the production of capillaries, collagen, and key proteins that promote healthier and softer skin. Copper also helps to fight odor due to its antibacterial and anti-fungal properties. Threads impregnated with thermos-reactive ceramic powder can be used to relieve pain, increase circulation by increasing blood flow and oxygen levels of the tissues, decrease swelling in the feet, decrease cold feet and numbness and treat ankle sprains. These threads contain thermos-reactive materials that convert heat into far-infrared rays, which are light rays having a wavelength between visible and microwave. Far-infrared waves can be used to relieve joint and tissue pain by increasing circulation and oxygen levels in the tissues. The band around the arch can also contain these threads, and these threads could be incorporated into other areas of the sock as well, such as the toes, bunion area, forefoot, mid-foot, rear foot, ankle and leg, etc.

In one embodiment, to increase the surface area of compression, the sock could also be configured with a separate compartment for each individual toe, so that there is an increased beneficial effect to the patient by increasing blood circulation, relieving inflammation, speeding up wound healing and decreasing the pain of arthritis. Thus, instead of two compartments (one for the big toe and the second for the other toes), there would be five compartments, one for each individual toc. The area of increased compression can then be disposed around the entire circumference of each toc. Unlike conventional socks, where the toes are in limited contact with the sock (touching only the top and bottom surfaces of the toes), the therapeutic sock with its individual compartments increases the sock-to-toe surface contact (top, bottom, and sides). This increase in surface area around the toe allows therapeutic fibers to be absorbed on the skin in a more efficient and uniform manner.

In one embodiment, the split grip sock device can be manufactured on a sock machine or a glove machine, or by any other conventional method as is known in the art. Using a flat knitting machine such as a glove machine reduces thickness, eliminates irritating seams, and makes the sock more comfortable and less irritating when worn. Further, the areas of increased compression can be formed by knitting the sock material in a different, tighter pattern in a band along the outside of the big toe, and around the second compartment, as well as in the band around the arch and/or around the ankle and heel, so that the body component fits tighter in the areas of increased elastic compression than in the rest of the body component. Alternatively, different threads could be incorporated into the body component that increases the density or tightness of the band so that the band exerts a compressive force on the area of the foot or toe that it contacts.

In yet another embodiment, the slip grip sock device comprises a plurality of indicia.

In yet another embodiment, a method of reducing slippage during lateral movements commonly performed during sports is disclosed. The method includes the steps of providing a split grip sock device comprising a body component with a first compartment for a user's big toe, a second compartment for the user's other toes, and traction components on the sole. The method also comprises inserting a user's foot into the split grip sock device, wherein a user's big toe is inserted into the first compartment and the user's other toes are inserted into the second compartment. Further, the method comprises securing the body component around the heel and ankle. Finally, the method comprises utilizing the split grip sock device while performing sports, such as basketball, football, soccer, or tennis.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
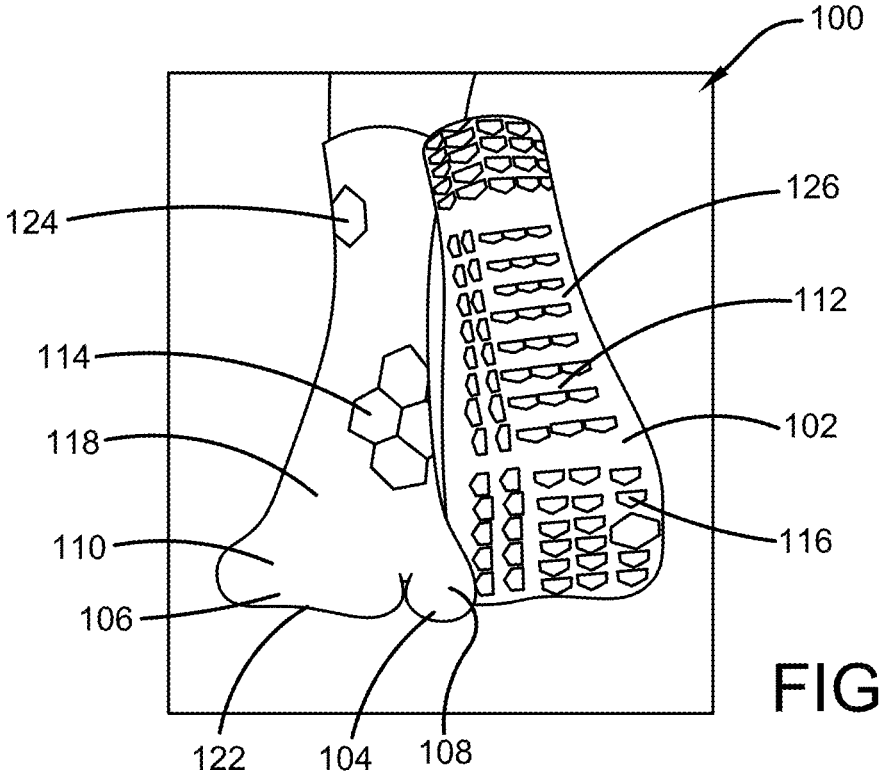
FIG. 1 illustrates a perspective view of one embodiment of the split grip sock device of the present invention showing the front and back of the device in accordance with the disclosed architecture.
Figure 2:
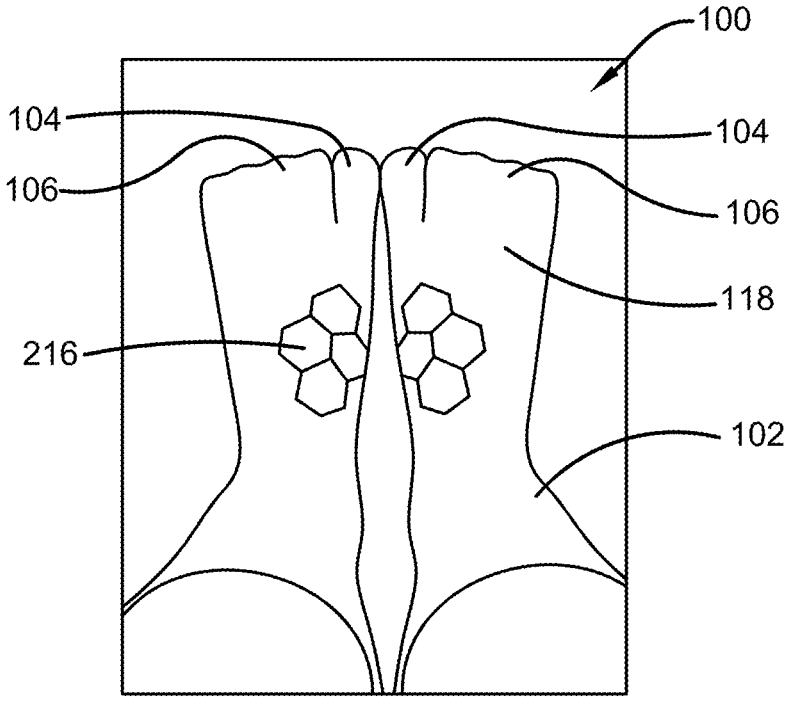
FIG. 2 illustrates a perspective view of one embodiment of the split grip sock device of the present invention showing the hexagon pads over the first and second metatarsals and medial and middle cuneiforms in accordance with the disclosed architecture.
Figure 3:
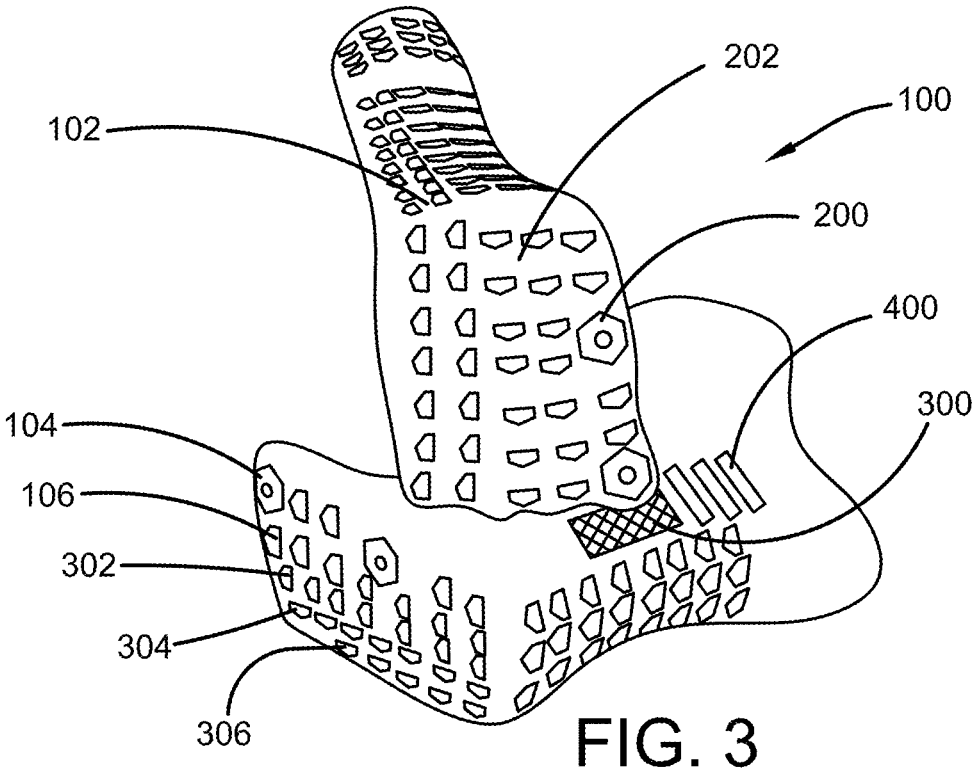
FIG. 3 illustrates a perspective view of one embodiment of the split grip sock device of the present invention showing the heat-pressed rubber pieces secured to the sole in accordance with the disclosed architecture.
Figure 4:
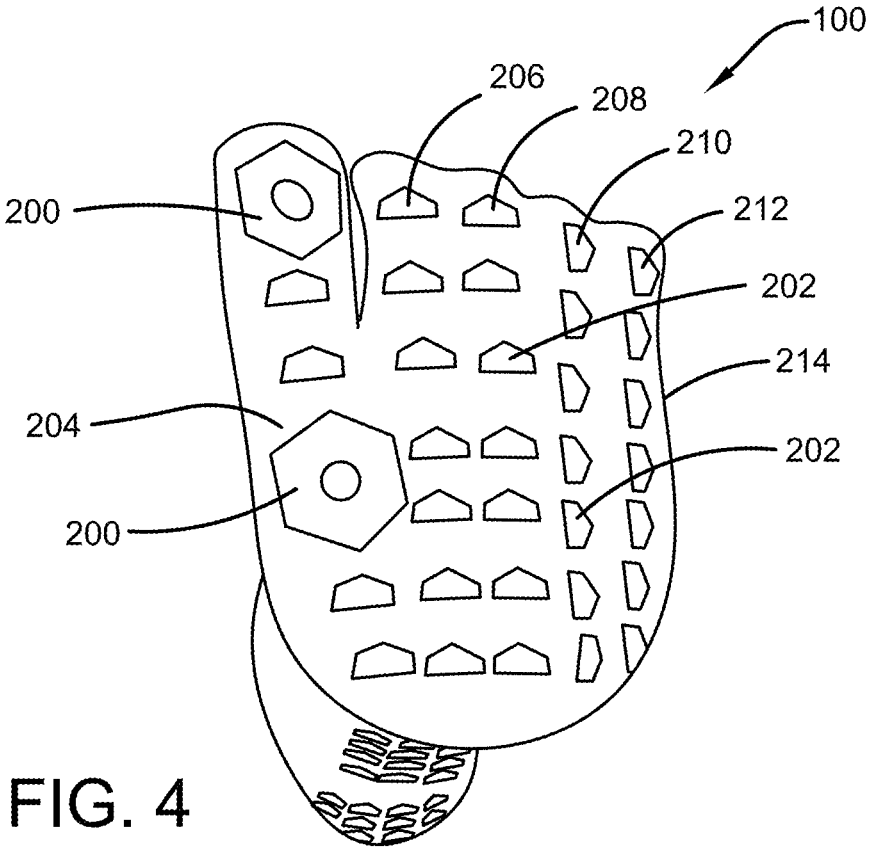
FIG. 4 illustrates a perspective view of one embodiment of the split grip sock device of the present invention showing the different toe compartments in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a split grip sock device that provides users with performance socks for those who play sports requiring significant lateral movement like basketball, soccer, football, and tennis. There is also a long-felt need in the art for a split grip sock device that allows users to slide their big toe into a small compartment to enable it to move independently when pivoting and pushing off the ground. Further, there is a long-felt need in the art for a split grip sock device that reduces friction on the top and heel area of the foot via hexagonal cushions or pads on the sock that contact the footwear. Moreover, there is a long-felt need in the art for a device that helps prevent slipping even with high amounts of sweat and moisture present within the shoe. Further, there is a long-felt need in the art for a split grip sock device that improves comfort, performance, and efficiency when playing sports or exercising. Finally, there is a long-felt need in the art for a split grip sock device that reduces slippage and prevents friction during use.

The present invention, in one exemplary embodiment, is a novel split grip sock device. Generally, the device comprises a body component that is configured into a separate compartment for the big toe and a second compartment for the rest of the user's toes. The device also features a thicker weave over the top of the foot and heel, with glued and heat-pressed rubber pieces on the bottom of the sole. The present invention also includes a novel method of reducing slippage during lateral movements commonly performed during sports. The method includes the steps of providing a split grip sock device comprising a body component with a first compartment for a user's big toc, a second compartment for the user's other toes, and traction components on the sole. The method also comprises inserting a user's foot into the split grip sock device, wherein a user's big toe is inserted into the first compartment and the user's other toes are inserted into the second compartment. Further, the method comprises securing the body component around the heel and ankle. Finally, the method comprises utilizing the split grip sock device while performing sports, such as basketball, football, soccer, or tennis.

Referring initially to the drawings, FIG. 1 illustrates a perspective view of one embodiment of the split grip sock device 100 of the present invention. In the present embodiment, the split grip sock device 100 is an improved split grip sock device 100 that provides a user with a sport performance sock that reduces slippage during lateral movements commonly performed during sports. Specifically, the split grip sock device 100 comprises a body component 102 with a first compartment 104 for a user's big toe 108 and a second compartment 106 for the rest of the user's toes 110. The device 100 also comprises gripping components 112 secured to a bottom 116 of the body component 102 for increasing traction and/or padded components 114 secured to all parts of the body component 102 for reducing friction. Thus, the device 100 provides a separate first compartment 104 for the big toe to allow for improved pivoting and change of direction and provides padded components 114 which cushion the metatarsals (i.e., top 118) to alleviate shoelace pressure and the heel area 120 to prevent blisters.

Accordingly, a split grip sock device 100 for the foot is provided, which can keep a user's toes 108 and 110 straight and reduces slippage during lateral movements, resulting in less irritation or discomfort while wearing shoes. Further, the separate toe compartments 104 and 106 allow for improved pivoting and change of direction, as needed. The sock device 100 can also reduce friction on the top 118 and heel area 120 of the foot and prevents slipping even with high amounts of sweat and moisture present within the shoe, due to the rubber pieces (i.e., gripping components 112) positioned on the body component 102.

Generally, the split grip sock device 100 comprises a body component 102 that includes a toe area 122, an ankle area 124, an arch area 126, and a heel area 120. The split grip sock device 100 is typically to be worn within a normal shoe, such as a professional or athletic shoe. Further, the split grip sock device 100 comprises a body component 102 formed of a tubular knit material with a closed toe area 122 and closed heel area 120, with an open ankle area 124 for inserting a user's foot during wear. The closed toe area 122 is separated into a first compartment 104 for accommodating the big toe 108, and a second compartment 106 for accommodating the four remaining toes 110.

As shown in FIGS. 2-5, the body component 102 also comprises glued and/or heat-pressed rubber pieces (i.e., gripping components 112) on the bottom 116 of the body component 102 for traction and on the heel area 120 and top 118 of the body component 102 to reduce friction from the shoe while in use. The rubber pieces 112 can be secured via adhesives, glue, heat-pressing, etc., or any other suitable securing means as is known in the art. Any suitable number of rubber pieces 112 can be applied to any suitable part of the body component 102, as is known in the art, depending on the needs and/or wants of a user.

Generally, the rubber grip elements 112 have two specific shapes, full red hexagon rubber pieces 200 and blue half hexagon rubber pieces 202, although any suitable color and shape can be utilized as is known in the art. Typically, the full red hexagon rubber pieces 200 are placed underneath the big toe 108 and at the part of the ball 204 of the foot directly below the big toe 108, specifically to provide traction when pivoting and pushing off. Any suitable number and size of hexagon rubber pieces 200 can be utilized on the body component 102, in any suitable position on the body component 102, to provide extra cushioning and traction, as needed.

Generally, the blue half hexagon rubber pieces 202 are positioned on the bottom 116 of the body component 102 and arranged typically in a column on the second 206 and third 208 toes. Typically, the blue half hexagon rubber pieces 202 point vertically up toward the user's toes 110 and allow for traction when running and backpedaling vertically. The blue half hexagon rubber pieces 202 are also positioned in a column on the fourth 210 and fifth 212 toes. Typically, the blue half hexagon rubber pieces 202 positioned here point toward the lateral side 214 of the user's foot to allow for better traction when moving laterally. Furthermore, additional blue half hexagon rubber pieces 202 can be positioned around the heel area 120 and big toe area 108, these rubber pieces 202 typically point toward a user's toes 110 to further provide traction when running and backpedaling. Any suitable number and size of hexagon rubber pieces 202 can be utilized on the body component 102, in any suitable position on the body component 102, to provide extra traction, as needed.

In addition to rubber pieces 200 and 202, the device 100 can compromise two orange hexagon pads 216 on the heel area 120 which comprise a thicker/fluffier knit material that provides padding to prevent friction that can cause blisters on a user's heel area 120. Additionally, the body component 102 comprises four orange hexagon pads 216 over the first and second metatarsal 118 and medial and middle cuneiforms which comprise a thicker/fluffier knit material that provides padding to alleviate lace pressure for the user. Furthermore, any number, shape, or color of padding 216 and rubber pieces 200 and 202 can be utilized to cushion and support the sock device 100, as is known in the art.

In one embodiment, the split grip sock device 100 does not comprise any additional padding or cushioning 216 on the heel 120 or top of the foot, but merely provides a plurality of glued and/or heat-pressed rubber pieces 200 and 202 on the bottom of the sole for traction. This embodiment would simply offer traction from the plurality of rubber pieces 200 and 202, as well as the separate compartment 104 and 106 for the big toe and other toes. This embodiment would be useful at places like indoor trampoline parks, where children are required to buy and wear grip socks because shoes are not allowed, or for childcare providers, who work at childcare centers where the teachers in the infant rooms cannot wear shoes because they may accidentally step on a crawling child's hands or feet, or any other suitable places as is known in the art.

In one embodiment, the split grip sock device 100 also comprises an area of increased compression 300 extending around the forefoot arch area 126, as well as at the heel 120 and ankle 124. The area of increased compression 300 can be formed by a tighter or different knitting pattern than the rest of the body component 102 and/or by incorporating threads of different materials or elasticity into the area. Further, the increased compression of the body component 102 in the arch area 126 will help reduce pain in those individuals with plantar fasciitis, and also help those individuals with painful flatfeet by helping to reduce muscle fatigue and strain by pulling up on the plantar fascia, and relieving tension on muscles, tendons, and ligaments. The increased compression and pressure in the arch 126, heel 120, and ankle 124 will also reduce swelling and edema, and at the same time control the rear foot and ankle, to help reduce ankle strains and sprains and help heel spurs.

Furthermore, to increase the surface area of compression, the body component 102 could also be configured with a separate compartment for each individual toe, so that there is an increased beneficial effect to the patient by increasing blood circulation, relieving inflammation, speeding up wound healing and decreasing the pain of arthritis. Thus, instead of two compartments 104 and 106 (one for the big toe 108 and the second for the other toes 110), there would be five compartments 104, 106, 302, 304, 306, one for each individual toc. The area of increased compression can then be disposed around the entire circumference of each toc. Unlike conventional socks, where the toes are in limited contact with the sock (touching only the top and bottom surfaces of the toes), the split grip sock device with its individual compartments 104, 106, 302, 304, 306 increases the sock-to-toe surface contact (top, bottom, and sides). This increase in surface area around the toe allows therapeutic fibers to be absorbed on the skin in a more efficient and uniform manner.

Figure 5:
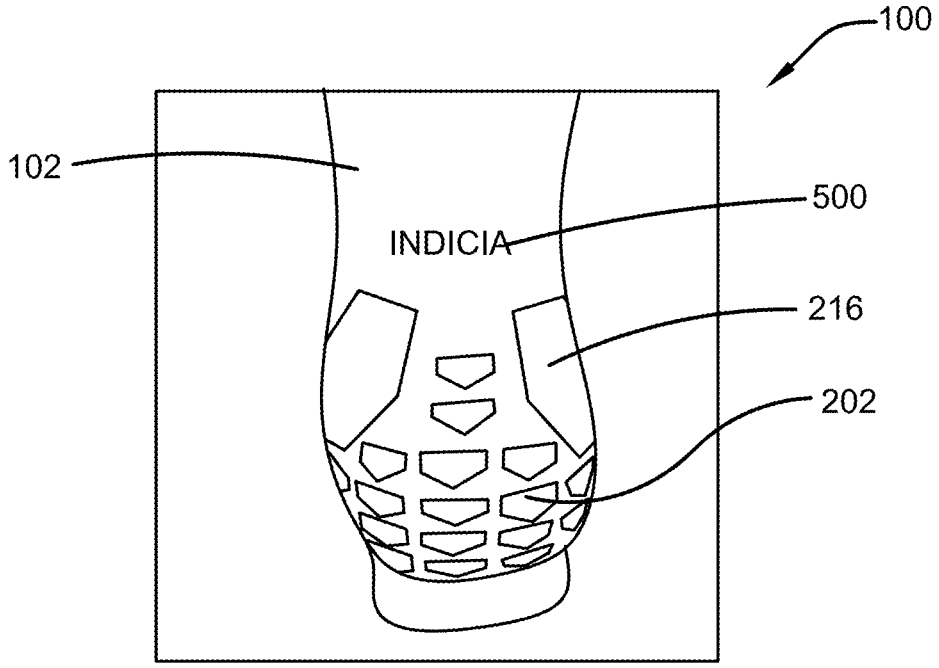
FIG. 5 illustrates a perspective view of one embodiment of the split grip sock device of the present invention showing the heel portion in accordance with the disclosed architecture.

As shown in FIG. 5, the split grip sock device 100 is manufactured of a knitted material such as cotton, spandex/lycra, nylon, and/or polyester. The body component 102 can also have an area 400 that utilizes a different material for therapeutic purposes. For example, an area 400 along the outside of the first compartment 104 can be knit with a combination of far-infrared thermos-reactive materials/bio-ceramic threads or copper threads or other threads such as bamboo, as these have therapeutic value. For example, socks incorporating copper can stimulate the production of capillaries, collagen, and key proteins that promote healthier and softer skin. Copper also helps to fight odor due to its antibacterial and anti-fungal properties. Threads impregnated with thermos-reactive ceramic powder can be used to relieve pain, increase circulation by increasing blood flow and oxygen levels of the tissues, decrease swelling in the feet, decrease cold feet and numbness and treat ankle sprains. These threads contain thermos-reactive materials that convert heat into far-infrared rays, which are light rays having a wavelength between visible and microwave. Far-infrared waves can be used to relieve joint and tissue pain by increasing circulation and oxygen levels in the tissues. The band around the arch 126 can also contain these threads, and these threads could be incorporated into other areas of the sock as well, such as the toes 108, 110, bunion area, forefoot, mid-foot, rear foot, ankle and leg, etc.

In one embodiment, the split grip sock device 100 can be manufactured on a sock machine or a glove machine, or by any other conventional method as is known in the art. Using a flat knitting machine such as a glove machine reduces thickness, eliminates irritating seams, and makes the sock device 100 more comfortable and less irritating when worn. Further, the areas of increased compression 300 can be formed by knitting the sock material in a different, tighter pattern in a band along the outside of the big toe 108, and around the second compartment 106, as well as in the band around the arch 126 and/or around the ankle 124 and heel 120, so that the body component 102 fits tighter in the areas of increased elastic compression than in the rest of the body component 102. Alternatively, different threads could be incorporated into the body component 102 that increase the density or tightness of the band so that the band exerts a compressive force on the area of the foot or toe that it contacts.

In yet another embodiment, the slip grip sock device 100 comprises a plurality of indicia 500. The body component 102 of the device 100 may include advertising, a trademark, or other letters, designs, or characters, printed, painted, stamped, or integrated into the body component 102, or any other indicia 500 as is known in the art. Specifically, any suitable indicia 500 as is known in the art can be included, such as, but not limited to, patterns, logos, emblems, images, symbols, designs, letters, words, characters, animals, advertisements, brands, etc., that may or may not be athletic, sock, or brand related.

Figure 6:
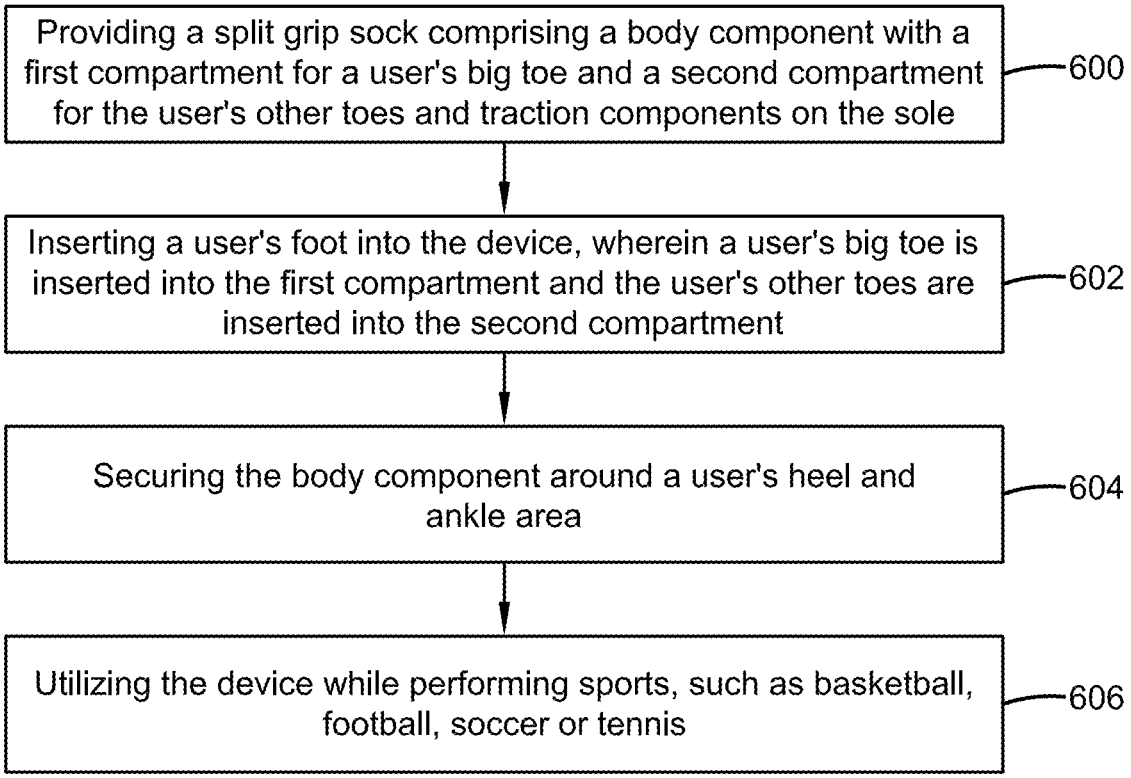
FIG. 6 illustrates a flowchart showing the method of reducing slippage during lateral movements commonly performed during sports in accordance with the disclosed architecture.

FIG. 6 illustrates a flowchart of the method of reducing slippage during lateral movements commonly performed during sports. The method includes the steps of at 600, providing a split grip sock device comprising a body component with a first compartment for a user's big toe, a second compartment for the user's other toes, and traction components on the sole. The method also comprises at 602, inserting a user's foot into the split grip sock device, wherein a user's big toe is inserted into the first compartment and the user's other toes are inserted into the second compartment. Further, the method comprises at 604, securing the body component around a user's heel and ankle area. Finally, the method comprises at 606, utilizing the split grip sock device while performing sports, such as basketball, football, soccer, or tennis.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "split grip sock device", "sock device", "split grip device", and "device" are interchangeable and refer to the split grip sock device 100 of the present invention.

Notwithstanding the foregoing, the split grip sock device 100 of the present invention can be of any suitable size and configuration as is known in the art without affecting the overall concept of the invention, provided that it accomplishes the above stated objectives. One of ordinary skill in the art will appreciate the split grip sock device 100 as shown in FIGS. 1-6 is for illustrative purposes only, and many other sizes and shapes of the slip grip sock device 100 are well within the scope of the present disclosure. Although the dimensions of the slip grip sock device 100 are important design parameters for user convenience, the slip grip sock device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A split grip sock device that provides a user with a sports performance sock that reduces slippage during lateral movements commonly performed during sports, the split grip sock device comprising:

a body component;

wherein the body component comprises a first compartment for a user's big toe and a second compartment for four remaining toes;

wherein the body component comprises a plurality of gripping components secured to a bottom of the body component for increasing traction;

wherein the body component comprises a plurality of padding components secured to the body component for reducing friction;

wherein the first compartment allows for improved pivoting and change of direction;

wherein the plurality of padding components cushion and prevent blisters;

wherein the body component comprises a toe area, an ankle area, an arch area, and a heel area;

wherein the split grip sock device is to be worn within a conventional shoe;

wherein the body component is formed of a tubular knit material with a closed toe area and a closed heel area, with an open ankle area for inserting a user's foot during wear;

wherein the closed toe area is separated into the first compartment for accommodating the user's big toe, and the second compartment for accommodating the four remaining toes;

wherein the plurality of gripping components are rubber pieces configured in a full or half hexagon shape;

wherein the plurality of gripping components are glued, adhered, or heat-pressed into the body component;

wherein the full hexagon rubber pieces are placed underneath the user's big toe and at a part of a ball of a user's foot directly below the user's big toe; and wherein the half hexagon rubber pieces are positioned on a bottom of the body component and arranged in a column on second and third toes and point vertically up towards a user's toes and allow for traction when running and backpedaling vertically.

2. The split grip sock device of claim 1, wherein the half hexagon rubber pieces are also positioned in a column on fourth and fifth toes and point toward a lateral side of the user's foot to allow for better traction when moving laterally.

3. The split grip sock device of claim 2, wherein the half hexagon rubber pieces are positioned around the heel area and big toe area, and point toward a user's toes to further provide traction when running and backpedaling.

4. The split grip sock device of claim 3, wherein the plurality of padding components comprise two hexagon pads on a heel area and four hexagon pads over a first and second metatarsal which comprise a thicker knit material that provides padding to prevent friction that can cause blisters.

5. The split grip sock device of claim 4 wherein the split grip sock device comprises only a plurality of gripping components secured to a bottom of the body component for increasing traction.

6. A split grip sock device that provides a user with a sports performance sock that reduces slippage during lateral movements commonly performed during sports, the split grip sock device comprising:

a body component comprising a toe area, an ankle area, an arch area, and a heel area; and wherein the body component is formed of a tubular knit material with a closed toe area and a closed heel area, with an open ankle area for inserting a user's foot during wear;

wherein the body component comprises a first compartment for a user's big toe and a second compartment for four remaining toes;

wherein the body component comprises a plurality of gripping components secured to a bottom of the body component for increasing traction;

wherein the body component comprises a plurality of padding components secured to the body component for reducing friction;

wherein the plurality of gripping components are half hexagon rubber pieces positioned on a bottom of the body component and arranged typically in a column on second and third toes and pointed vertically up towards a user's toes and allow for traction when running and backpedaling vertically;

wherein the plurality of gripping components are half hexagon rubber pieces positioned in a column on fourth and fifth toes and pointed toward a lateral side of the user's foot to allow for better traction when moving laterally;

wherein the plurality of gripping components are half hexagon rubber pieces positioned around the heel area and big toe area and pointed toward a user's toes to further provide traction when running and backpedaling;

wherein the plurality of padding components comprise two hexagon pads on a heel area and four hexagon pads over a first and second metatarsal which comprise a thicker knit material that provides padding to prevent friction that can cause blisters; and wherein the body component is further configured with a separate compartment for each individual toe.

7. The split grip sock device of claim 6 further comprising a plurality of indicia.

8. The split grip sock device of claim 6, wherein the body component is manufactured of a knitted material such as cotton, spandex, lycra, nylon, or polyester.

9. The split grip sock device of claim 6, wherein the body component comprises an area that utilizes a different material for therapeutic purposes.

10. The split grip sock device of claim 6 further comprising an area of increased compression extending around the arch area, as well as at the heel area and the ankle area.

* * * * *